US006101790A

United States Patent [19]

Mori et al.

[11] Patent Number: 6,101,790

[45] Date of Patent: Aug. 15, 2000

[54] PACKING BAND, PACKING METHOD AND PACKING APPARATUS, OF LITTLE PARTS, AND MOUNTING METHOD OF ELECTRONIC PARTS

[75] Inventors: Kazuhiro Mori, Katano; Eiji Itemadani, Sakai; Souhei Tanaka, Neyagawa; Uzo Tomii, Ikoma-gun; Yukihiko Asao, Kasugai; Yozo Uotsu, Nishinomiya, all of Japan

[73] Assignees: Matsushita Electric Industrial Co., Ltd; Nissho Corporation, both of Osaka, Japan

[21] Appl. No.: 09/113,887

[22] Filed: Jul. 10, 1998

[30] Foreign Application Priority Data

Jul. 23, 1997 [JP] Japan ..... 9-197419

[51] Int. Cl.[7] ..... B65B 15/04; B65D 73/02

[52] U.S. Cl. ..... 53/453; 53/492; 53/553; 53/559; 206/714

[58] Field of Search ..... 53/453, 452, 559, 53/553, 492; 206/714

[56] References Cited

U.S. PATENT DOCUMENTS

| | | | |
|---|---|---|---|
| 3,465,874 | 9/1969 | Hugle et al. | 206/714 |
| 4,298,120 | 11/1981 | Kaneko et al. | 206/714 X |
| 4,724,958 | 2/1988 | Kaneko et al. | 206/714 |
| 5,132,160 | 7/1992 | Bird | 206/714 X |
| 5,494,168 | 2/1996 | Hart | 206/714 |
| 5,526,935 | 6/1996 | Tidemann et al. | 206/713 |

FOREIGN PATENT DOCUMENTS

| | | |
|---|---|---|
| 29605702 U1 | 7/1996 | Germany . |
| 61-119957 | 7/1986 | Japan . |
| 61-217363 | 9/1986 | Japan . |
| 02109815 | 4/1990 | Japan . |
| 04102518 | 4/1992 | Japan . |
| 06-219412 | 8/1994 | Japan . |
| 8503063 | 6/1987 | Netherlands . |
| WO94/00971A1 | 1/1994 | WIPO . |
| WO97/03545A1 | 1/1997 | WIPO . |

*Primary Examiner*—James F. Coan

[57] ABSTRACT

The band 10 which stores little parts 20 in many storing dents 14 arranged along a longitudinal direction and packs the little parts 20 by covering surfaces of the storing dents 14 with a cover tape 30, and is made of a flexible material having a compress-forming nature, and comprises storing dents 14 which are compress-formed from a surface to a fixed depth in a thickness direction.

23 Claims, 7 Drawing Sheets

PACKING BAND, PACKING METHOD AND PACKING APPARATUS, OF LITTLE PARTS, AND MOUNTING METHOD OF ELECTRONIC PARTS

BACKGROUND OF THE INVENTION

1. Technical Field

The present invention relates to a packing band, a packing method and a packing apparatus, of little parts, and a mounting method of electronic parts, and more particularly, to a packing band which is used to carry very little electronic parts such as chip resistances and other little parts for transportation and deposit and so on and is for keeping in the condition of packing together many little parts, a packing method using the packing band, a packing apparatus used in the packing method and a method of mounting electronic parts packed by the packing band to loading positions.

2. Background Art

There exists a carrier tape as a carrying technique of electronic parts, especially, very little electronic parts such as chip resistances which have the size of only several mm.

A structure example of the carrier tape used for carrying the very little electronic parts, is shown. To a long-film like band made of a synthetic resin sheet, storing dents of the electronic parts are emboss-formed along the longitudinal direction. After the electronic parts are stored in the storing dents, a transparent cover tape sheet is stuck to the surface of the band. When the electronic parts are supplied to a mounting apparatus and so on, the electronic parts are taken out from the individual storing dent while the cover tape of the carrier tape is peeled off.

In the synthetic resin carrier tape of the emboss structure like this, the disposal after taking out the electronic parts, is difficult. As for the band made of the synthetic resin, there is a restriction in the disposal using destruction by fire or filing-up because of the problem of the environmental pollution. Also, as the swelling figure corresponding to the figure of the swelling dent projects toward the back face of the carrier tape, when the fellow carrier tapes are piled up above and below or are rolled up in a roll shape, and are deposited, there is a problem that piling up and rolling up are difficult because the swelling figure to the back face disturbs.

It is proposed to use a paper material which is easily disposed, as the carrier tape. A structure example of the carrier tape using a paper material is shown. To the band made of a paper which has a thickness to some extent, many storing dents of the electronic parts are formed by piercing along the longitudinal direction. By sticking a thin film made of a paper or a synthetic resin to the back face of the band, the bottoms of the storing holes are formed. After storing the electronic parts in the storing holes of which bottoms are formed by the film, a cover tape is stuck to the surface of the band.

As a result, it becomes the condition that the electronic parts are protected and stored in the every storing hole of the band. If the carrier tape wherein the electronic parts are stored, is rolled up and kept in a reel shape, it does not become bulky and the carrying treatment becomes easy. As the swelling portion does not exist on the back face of the carrier tape, the rolling up is easy.

In the above-mentioned conventional carrier tape, as stuffs constituting the storing portions of the electronic parts, two stuffs of the band and the film stuck to the back face of the band, are necessary and a step of sticking the film to the back face of the band, is necessary. Therefore, there are problems that the packing work takes time and the packing cost becomes high. As the film of the back face is thin, the bottom of the storing portions becomes thin and the protection of the electronic parts becomes insufficient.

As the bands of different dimensions and figures must be prepared to the every dimension and figure of the electronic parts, the stock management of the bands is troublesome and a large area is necessary for the deposit of the bands. To change the packing electronic parts while the packing work, the packing work must be interrupted once and it takes time to change to another band.

If the storing portions are piercing-processed to the band, there is a problem that material powders occurring at the time of processing stick to the circumference of the storing portion and stick to the electronic parts. In case of the very little and precise electronic parts, the sticking of processing powders is not preferable.

The above problem occurs in case of packing in the carrier tape system not only the said electronic parts but also other very little parts.

SUMMARY OF THE INVENTION

A. Objects of the Invention

Thus, an object of the present invention is to provide a packing band, a packing method and a packing apparatus, of little parts, wherein the problems which the said conventional carrier tape has, are solved and the packing work is easy and economical.

B. Disclosure of the Invention

A packing band of little parts, according to the present invention, is a band which stores little parts in many storing dents arranged along a longitudinal direction and packs the little parts by covering surfaces of the storing dents with a cover tape, and is made of a flexible material having a compress-forming nature, and comprises storing dents which are compress-formed from a surface to a fixed depth in a thickness direction.

A packing method, according to the present invention, is a method which packs by storing little parts in storing dents of the said packing band and covering a surface of the storing dents with a cover tape, and comprises the below steps (a)–(d):

(a) a step of travelling to a fixed direction the band before being formed the storing dents;

(b) a step of press-forming the storing dents which have a depth from a surface of the band to a midway of a thickness with preventing to swell to a back side of the band;

(c) a step of storing the little parts in the storing dents of the band; and (d) a step of connecting the cover tape to a surface of the band with covering the storing dents.

These and other objects and the advantages of the present invention will be more fully apparent from the following detailed disclosure.

DETAILED DESCRIPTION OF THE INVENTION

Figure 1:
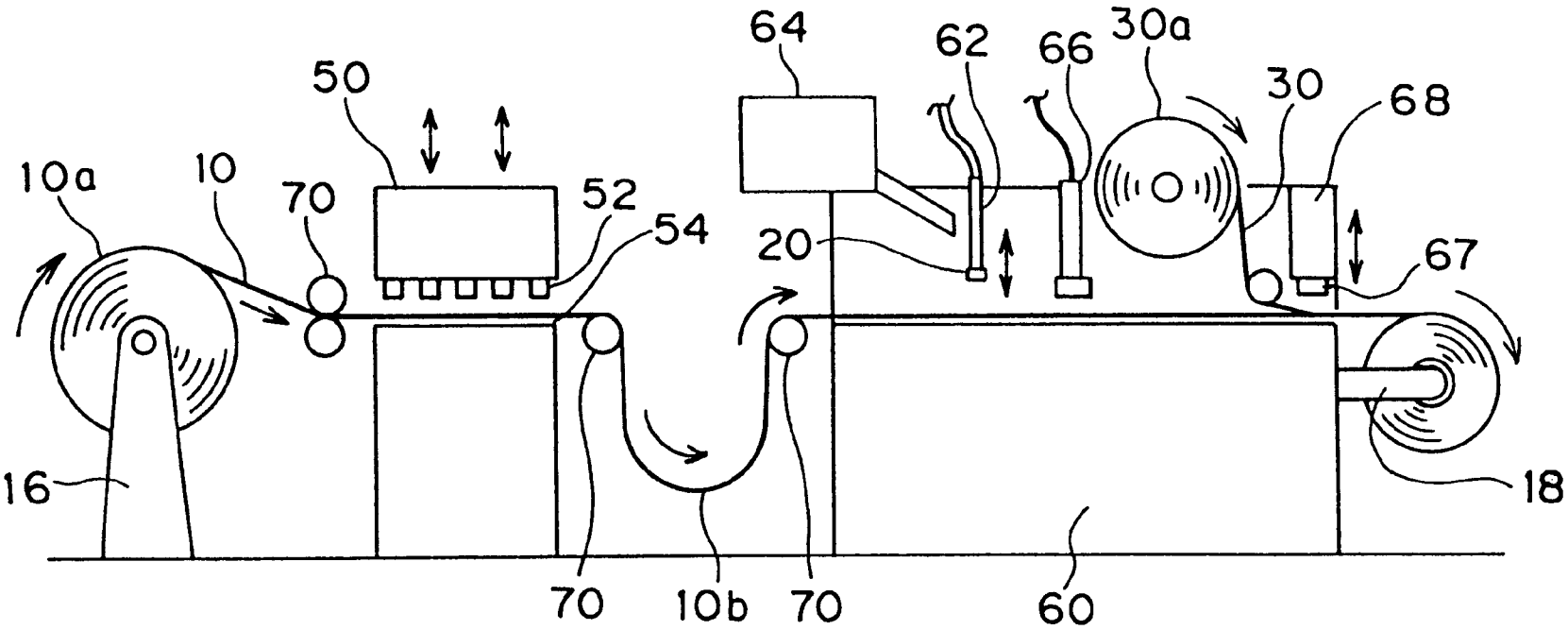
FIG. 1 is a rough front view of a packing apparatus showing an embodiment according to the present invention.

Respective composing elements are concretely explained below.

Little Parts

Various parts packed by the conventional carrier tape system, can be applied.

The present invention is properly used to the electronic parts and other precise parts wherein many parts are necessary to be carried in the sufficient protecting condition. For electronic parts, a chip resistance, a chip condenser and various sensor chips are listed.

The figure of the little parts are not especially restricted. Rectangular parallelepiped like and other many-sided cube like, solid figures which have a curve portion such as a column and hemisphere like, and figures which have pins and other projections on the surroundings can be applied.

Band

Material of the band is fundamentally used the same as a tape material which is used in the conventional carrier tape as far as the material has a flexibility to the extent that treatment such as rolling up in a reel shape at the time of carrying is possible and a compress-forming nature to the extent that the storing dents can be formed by press-forming. The material which is able to be compress-formed in a range of 70–95%, is preferable. Concretely speaking, a film material or a sheet material made of, a synthetic resin, a foaming resin a ceramic, a paper and a fiber and so on, can be used in a single layer or in plural layers. A paper material combined a natural fiber and a synthetic fiber, can be used. It is preferable to use material which is easy for abolishing treatments such as destruction by fire.

If electrically conducting material is used for the band or if the electrically conducting treatment or the a charge preventing treatment is applied to the surface, the electronic parts are preferably packed. To a synthetic resin or a paper constituting the band, the electrically conducting material such as a carbon black can be mixed. The material which has a good adhesion and a good releasability to the cover tape stuck to the surface of the band, is preferable.

The width and the thickness are established according to the dimension of the stored little parts. Especially, the thickness of the band should be established at least a little thicker than the height dimension of the little parts. Concretely speaking, in case of being used to pack, for example, the electronic parts, any of the dimension value of the width and the thickness of the carrier tape standardized by JIS and so on, can be employed. The thickness of the band is preferably 0.40–0.95 mm. The width of the band is preferably 4–8 mm. The length of the band is preferably 1000–5000 m. A paper material of weight 335–730 g/m$^2$ is preferably used.

To the band, a feeding means such as feeding holes used to travel mechanically, can be established. For the feeding means, a mechanism structure such as holes or slits, notches and projections which travel the conventional band like material, is employed. The feeding means is, usually, formed in the both side edges of the band which do not disturb the keeping of the electronic parts. However, the feeding means may be formed in the one-side edge and may be formed in the center if the storing of the little parts is not disturbed.

The band which is formed the feeding means beforehand, may be used and the processing step of the feeding means can be performed successively before or after the packing work of the little parts by a packing apparatus according to the invention with the band which does not have the feeding means.

For the band, the wide band wherein the many storing dents can be arranged side by side. In this case, by cutting off the band in the midway of the storing dents in the width direction after press-forming the many storing dents side by side in the width direction of the band, the band wherein one line or optional lines of the storing dents are arranged, is obtained.

Storing Dents

The area and the depth for storing and keeping the little parts, are necessary. It is preferable that the depth of the storing dents is deeper than the height of the little parts stored in the storing dents. The figure of the storing dents is fitted to the figure of the little parts and the figure which is able to be press-formed, is employed. Concretely speaking, the figures which have a pipe shape connecting to a depth direction of a polygon, a circle, an ellipse and other figures. The unevenness figure corresponding to the unevenness figure of the little parts, can be formed on inner sides of the storing dents. The taper like dents which become narrow from the surface side of the storing dents to the inner part side of at least one-side of side wall among inner side walls of the storing dents, can be used.

The depth of the storing dents is established a little shallower than the thickness of the band. The depth of the storing dents is preferably ½ or more of the thickness of the band. The depth of the storing dents is preferably 0.35–0.90 mm. The allowable error of the depth of the storing dents is preferably within ±1.5%. The concrete value of the preferable allowable error is different according to the depth of the storing dents and The allowable error is ±0.1 mm in case of the depth of 0.85 mm in maximum and the allowable error is ±0.03 mm in case of the depth of 0.30 mm in minimum. The difference between the thickness of the band and the depth of the storing dents, is the thickness of the bottom portions of the storing dents. To protect sufficiently the little parts, it is preferable to make thick the thickness of the bottom of the storing dents.

Cover Tape

Material and structure are used the same as a cover tape or a film which are used in the conventional carrier tape. For the material of the cover tape, a synthetic resin a paper and so on are used. In case of a transparent tape, the condition of the little parts stored in the storing dents can be observed even in the packing condition. When the cover tape is connected to the band by heat-bonding, a heat bonding material is used.

Travelling of Band

To travel the band, an apparatus is used the same as a carrying travelling means which is used in the conventional carrier tape. As for the band, fixed length materials which are cut off in the every fixed length may be travelled in order. However, if a long-film like band is rolled up and kept in a reel shape and one-end is pulled up and travelled and the band finished the treatment is rolled up again in a reel shape and withdrawn, the efficient work is possible and the supplement of the band and the treatment of a pack body packed the little parts become easy.

If a feeding mechanism which is fitted to the feeding means such as feeding holes of the band, is established, the certain travelling becomes possible.

When the band is travelled to a fixed direction, the band may be continuously successive-travelled at a fixed speed, or the band may be stopped once at each treating step and may be successive-travelled while repeating travelling and stopping intermittently as start again travelling after the treatment is finished. To absorb the difference of the travelling condition of the band at each treating step, travelling adjusting portions which loose a fixed quantity of the band, can be established at the midway of each treating step.

The said wide band may be supplied and travelled and the bands after the processing of cutting off in the width direction, can be withdrawn by another reel, respectively.

For the withdrawal of the band, so-called record rolling wherein the band is rolled up in order with arranging the width, can be performed and so-called traverse rolling wherein the band is rolled up with waving to right and left in the width direction, can be performed. By the traverse rolling, a long-film product of about 2000 m–6000 m can be obtained.

Press-forming Step

Press-forming technique to the synthetic resin material and the paper material which are conventional, can be applied. Concretely speaking, by pressing from the surface side of the band with a press mold corresponding to the figure of the storing dents, the storing dents along the figure of the press mold. The press mold is controlled to be inserted only to the midway of the thickness of the band. Also, it is preferable that a flat base is applied to the back side of the band so that the swelling does not occur on the back side of the band when the storing dents are press-formed. By pressing the surroundings of the storing dents on the surface side of the band with a flat pressing plate, the forming accuracy, especially the accuracy of the depth direction is improved.

At the time of press-forming, the forming of the storing dents is able to become easy by heating at the same time with pressing. As a forming mold, a heating press mold which has a heater and so on, can be used.

By controlling the temperature and the humidity at the time of the press-forming, the storing dents which have a stable quality and a high accuracy, can be formed. By controlling the temperature of the working oil supplied to an oil pressure mechanism which controls the work of the press mold, the work position of the press mold can be exactly controlled and the accuracy of the storing dents can be improved. The formed-figure of the storing dents can be examined by in-line with the optical examining apparatus using a laser beam and so on and the examining results can be feed-backed to the temperature control of the said working oil.

By press-forming, the storing dents which have the depth from the surface of the band to the midway of the thickness, are formed and the swelling does not occur on the back side of the band.

In press-forming chopping powders and cutting powders do not occur from the band. The bottom portions of the storing dents which are press-formed, have a excellent strength as the material of the thickness portions of the band is thinly compressed.

As press-forming, a method of repeating plural times of press-forming by enlarging the press molds by stages such as so-called two-times pressing which presses with the press mold corresponding to the external form of the objected storing dents after pressing with the press mold a little smaller than the necessary external form to form the objected storing dents. After press-forming, shaving processing can be performed. These methods are useful to the improvement of the accuracy of the storing dents, the prevention of raising nap at inner face of the storing dents and the control of the reconstruction after forming.

If a knuckle mechanism press is used as the press-forming apparatus, the working position of the press mold is exactly controlled.

If raising nap of a fiber or very little powders occur in the storing dents formed by press-forming, the raising nap and the very little powders can be destructed by fire by irradiating a laser beam. By inserting to the storing dents a heat form-arranging mold which has a external form a little smaller than the storing dents and is heated in high temperature, the said raising nap can be removed and modifications by the reconstruction after press-forming, can be modified.

Storing Step of Little Part

A parts supplying means to the conventional carrier tape, is used. So-called parts feeders and parts carrying apparatus and so on, are used. By absorbing and keeping the little parts with a vacuum nozzle, the damage of the little parts is prevented and the efficient treatment is possible.

Generally, one little part is stored in one storing dent. However, plural little parts can be stored in one storing dent.

To examine if the little parts are properly stored in the storing dents, an examining step can be performed after the storing step. For the examining step, the examining method and apparatus which are used in the conventional products examining work such as an optical examination by an optical sensor and a image sensor and so on, a magnetic examination and an examination by an air pressure, are used.

If the gluing layers are arranged at the bottoms of the storing dents before the little parts are stored in the storing dents, the movement and the impact to the inner walls of the storing dents, of the little parts while the transporting treatment, can be prevented. For the forming means of the gluing layers, coating or supplying a liquid gluing agent to the storing dents by a nozzle and so on, is possible. If magnetic layers are formed instead of the gluing layers, the little parts such as the electronic parts including magnetic metal material, can be fixed to the storing dents by a magnetic force. By arranging a magnetic body or an occurring magnetic mechanism at the structure portions positioned on the lower face of the storing dents in the travelling way of the band and applying a magnetic force to the electronic parts, it is prevented that the electronic parts flow up from the storing dents.

Connecting Step of Cover Tape

The cover tape is supplied as cover the storing dents on the upper part of the traveling band and is connected to the surface of the band.

The cover tape can be rolled up and kept in a reel shape as the band and supplied by pulling up from one-end in order.

As a connecting means of the cover tape to the band, connecting by an adhesive and a gluing agent, a heat-bonding, a frequency bonding and other connecting means of the conventional fellow tape materials, can be used. The cover tape which is formed gluing layers or adhesive layers beforehand on the surface, can be used.

As for the connecting positions of a cover tape to the band, the positions which can prevent at least falling off of the little parts stored in the storing dents, should be connected. For example, linear like or intermittent linear like and spot like and so on can be connected along the both sides of the storing dents, or all surroundings of the four quarters of the storing dents can be connected. The all face of the cover tape can be connected to the band.

When the little parts are taken out, it is preferable that the cover tape can be comparatively easily removed. For that purpose, it is sufficient to connect with the minimum strength and positions to the extent that the little parts do not fall off at the time of treating after packing.

The carrier tape which includes the band of which the storing dents stored the little parts, are covered by the cover tape, can be treated in the same way as the conventional carrier tape. As the projections or the swelling portions corresponding to the storing dents, do not exist on the back face of the band, when the carrier tapes are piled up or rolled up in a reel shape, the fellow carrier tape can be piled up exactly without occurring gaps and differences of level and they are not bulky and the treatment becomes easy.

Mounting Method of Electronic Parts

The electronic parts as the little parts packed by the above-mentioned packing band, are used by being mounted to the loading positions of circuit plates and so on.

The mounting method, as employed, comprises the below steps (m)–(p):

(m) a step of travelling to a fixed direction the packing band;

(n) a step of peeling off the cover tape from the packing band;

(o) a step of taking out the electronic parts from the storing dents of the packing band; and (p) a step of mounting the electronic parts to the loading positions.

According to the above-mentioned method, taking out of the electronic parts from the packing band and mounting are efficiently performed.

(Effects and Advantages of the Invention):

In the packing band according to the present invention, as it is not necessary to stick a film to the back face of the band, a number of materials is decreased and a number of steps of the packing work is decreased. Moreover, as the compress-formed bottom portion of the storing dents is compressed, it has the excellent strength and the protecting efficiency of the little parts is increased. Also, as processing powders do not occur from the is prevented.

As the storing dents are formed as swelling does not occur on the back side of the band, it is prevented that the swelling figure disturbs the carrying of the band while the packing work. Also, if the band before packing or the band packed the little parts are piled up or rolled up in a reel shape, unnecessary gaps do not occur between the fellow bands and the band does not slip and the efficient treatment is possible.

According to the packing method and the packing apparatus of the present invention, adding to the effects achieved by using the above-mentioned packing band, only by preparing the band of a material without being formed the storing dents, the press-forming of the storing dents to the band, the storing of the little parts and the connecting of the cover tape are successively performed and the packing of the carrier tape system is efficiently performed.

If the dimensions and the figures of the stored little parts are different, only one kind of the band should be prepared. Therefore, the labor and the cost for manufacturing of the band and the deposit treatment are decreased.

According to the mounting apparatus of the electronic parts of the present invention, by packing the electronic parts with the said packing band, the mounting work of the electronic parts is efficiently performed.

DETAILED DESCRIPTION OF THE PREFERRED EMBODIMENTS

A packing apparatus shown in FIG. 1 is a case of packing chip resistances as the little parts 20. As for the chip resistances, for example, a rectangular parallelepiped like chip resistances of 3.2×2.5×0.6 mm and very little chip resistances of about 0.6×0.3×0.3 mm, are known. The thickness range is about 0.3–0.85 mm.

[Structure of Packing Apparatus]

A band reel 10*a* wherein a band 10 made of a paper material is rolled up in a reel shape, is supported with free-rotating by a reel keeping beam 16. The width of the band is sufficiently wider than the width of the little parts 20 and is, for example, the width of 8 mm, the width of 4 mm. The length of the band 10 is from several hundreds m to a thousand m or more.

The band 10 which has below characteristics, can be used.

thickness: 0.63–0.95 mm density: 0.36–0.82 g/cm$^3$ lubricating degree: 60–66 cm tensile strength: length 68–86 kgf/width 27–53 kgf elastic degree: length 2.9–3.3%/width 8–8.5% strength degree: length 690–1700 gfcm/width 290–840 gfcm picking: surface 13A/back 14A moisture: 9.5–12%

Z-axis peeling: 31–34 kg/in$^2$

Rust occurring test: B peel strength: surface 29–32 g surface coarseness: surface 2.4–2.7 Ra heavy metal: not include cadmium, mercury, chromium (VI)

harmful substance: not include specific flon, carbon tetrachloride, trichloroethane One-end of the band 10 is pulled up from the band reel 10*a* and passes through a guide roll 70 and is supplied to a press-forming portion 50. The press-forming portion 50 travels the band 10 between a flat base 54 and a free fluctuating press mold 52 and press-forms the band by the fluctuating movement of the press mold 52.

In the downstream side of the press-forming portion 50, a packing portion 60 ia arranged via a travelling adjusting portion 10*b*. The travelling adjusting portion 10*b* looses a fixed quantity of the band in the midway of guide rolls 70, 70 arranged before and behind. By this loosing of the band 10, the difference of the travelling condition of the band 10 between the press-forming portion 50 and the packing portion 60.

In the packing portion 60, a parts feeder 60, a parts supplying nozzle 62, an image examining tool 66, a cover tape rolling up reel 30*a*, a heat-seal tool 68 and a rolling up frame 18 are arranged in order in the upper part of the travelling path of the band 10.

The parts feeder 64 stores the many little parts 20 and feeds the little parts in order to the operating position of the parts supplying nozzle 62. The parts supplying nozzle 62 is connected to a vacuum source (not drawn in the figure) and absorbs and keeps the little parts at a pointed end. The image examining tool 66 catches optically the conditions of the band 10 and the little parts 20. Information obtained by the image examining tool 66 is treated by an image treating apparatus (not drawn in the figure) and is examined. To the cover tape rolling up reel 30*a*, a cover tape 30 made of a transparent synthetic resin film such as a PET resin, is rolled up. In the heat seal tool 68, the band 10 and the cover tape 30 are heat-bonded by a heat-bonding edge 67 established on the lower edge. To the rolling up frame 18, the band 10 packed the little parts 20 is rolled up.

[Packing Work]

Figure 2:
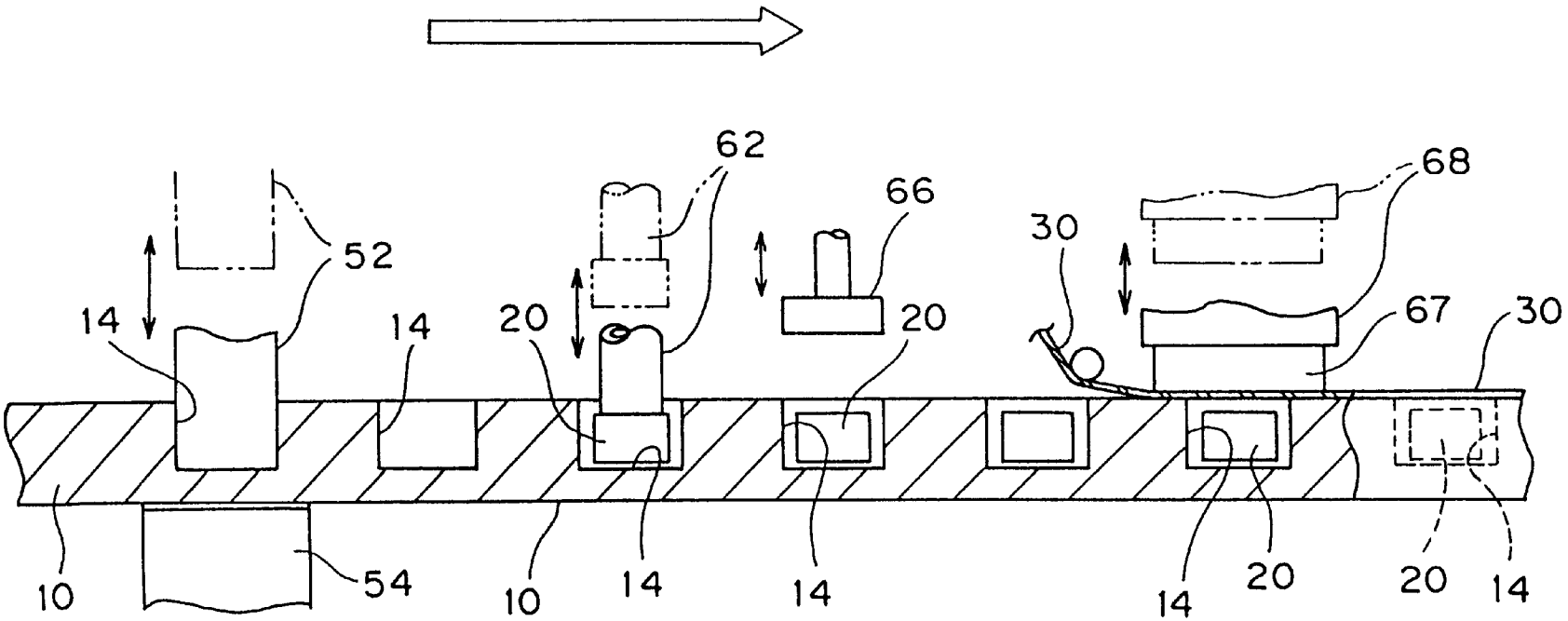
FIG. 2 is a typical sectional view showing packing steps in order.

FIG. 2 shows the packing work in a step order.

Figure 3:
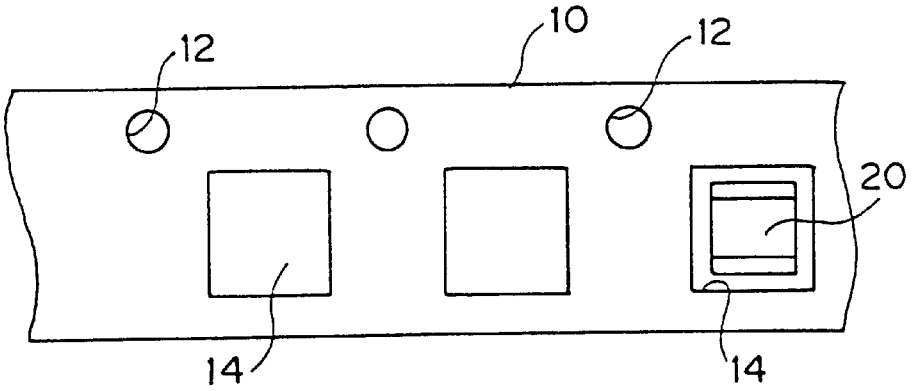
FIG. 3 is a top view showing a condition movement of a band in packing steps.

As shown in FIG. 3, the band 10 is a thin-width long-film like and feeding holes are piercing-formed at regular intervals along one-sided edge.

When the band is arranged just under the press mold 52, the press mold descends On the upper face of the band 10, the storing dents 14 corresponding to the figure of the press mold 52, are formed. As shown in FIG. 3, the storing dents 14 are in a plane square shape. As the press mold 52 descends only to the midway of the thickness of the band 10, the storing dents 14 of the depth to the midway of the thickness, are formed. As the flat base 54 is applied to the lower face of the band at the time of press-forming, the swelling figure is not formed on the lower face of the band and the flat back face remains. Therefore, in the bottom portion of the storing dents 14, the thickness of the band 10 is compressed and becomes a thinly hardening condition. Compress-forming is to the extent that the thickness of the band 10 is about 0.5 mm.

For example, when the storing dents 14 of the depth of 0.90 mm are formed to the band 10 of the thickness of 0.95 mm, the compressing rate of the band 10 is 95%. When the storing dents 14 of the depth of 0.35 mm are formed to the band 10 of the thickness of 0.40 mm, the compressing rate of the band 10 is 87.5%.

When the storing dents 14 of the band 10 comes to the operating position of the parts supplying nozzle 62, the little parts 20 absorbed by the parts supplying nozzle 62, are supplied into the storing dents 14.

When the little parts 20 stored in the storing dents 14 come to the position of the image examining tool 66, the image examining tool 66 catches the image of the little parts 20 and the storing dents 14. By analyzing and operating this image with the image treating apparatus, it can be examined if the figure of the storing dents 14 is exactly formed, if the little parts 20 are stored certainly in the storing dents 14, if the pose of the little parts 20 in the storing dents 14 is proper or not. If the badness is found as the result of the examination, the packing work is interrupted and redoing of the work and adjusting of the apparatuses and so on are performed.

Figure 4:
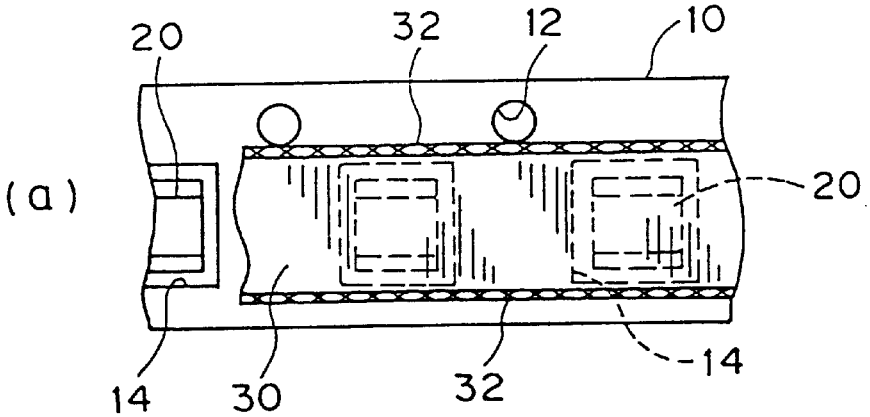
FIG. 4(*a*) is a part lacking top view and FIG. 4(*b*) is a side sectional view showing a carrier tape finished a packing.
Figure 4:
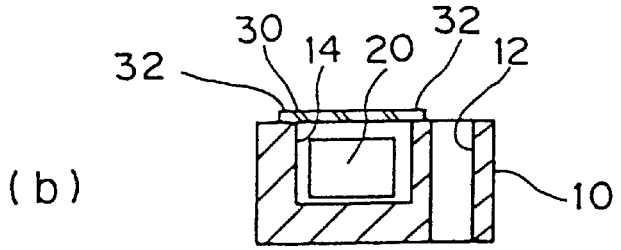

The cover tape 30 is supplied on the storing dents 14 stored the little parts 20. As shown in FIG. 4, the cover tape 30 has the width a little wider than the width of the storing dents 14 and does not cover the position of the feeding holes 12 of the band 10.

The heat-bonding edge 67 of the heat seal tool 68 pushes up the cover tape 30 to the band 10 and heats and melts. For the condition of heat-bonding, the heat-bonding edge 67 is pushed up with a hundred and several tens ° C. and about one second. The heat-bonding edge 67 includes two edges along the both side edges of the cover tape 30 and, as shown in FIG. 4, heat-bonds the cover tape 30 to the band 10 outside the storing dents 14 and two linear like heat-bonded portion 32 is formed. As the cover tape 30 is transparent, the little parts 20 in the storing dents 14 can be recognized through the cover tape 30.

As shown in FIG. 1, the band 10 stuck the cover tape 10, that is to say, the carrier tape in the packing condition is rolled up by the rolling up frame 18 and withdrawn. As both the surface and the back of the band 10 are flat, gaps or lags do not occur between the fellow bands 10 in the rolling up condition, the band 10 can be rolled up in order and tightly.

The carrier tape withdrawn by the rolling up frame 18 is transported and deposited in a reel shape. The carrier tape can be cut off in the every proper length and rolled up in a reel shape. For example, the carrier tape of about 20 m can be rolled up to a reel of 178ϕ.

When the packed little parts are used, as the conventional carrier tape, being mounted to the electronic parts mounting apparatus and so on, the little parts 20 are taken out from the storing dents 14 with peeling off the cover tape 30 from the band 10.

[Mounting Work]

The method of taking out the electronic parts 20 as the little parts 20 from the packing band 10 packed the electronic parts such as chip resistances and mounting to the loading positions, is explained.

Figure 5:
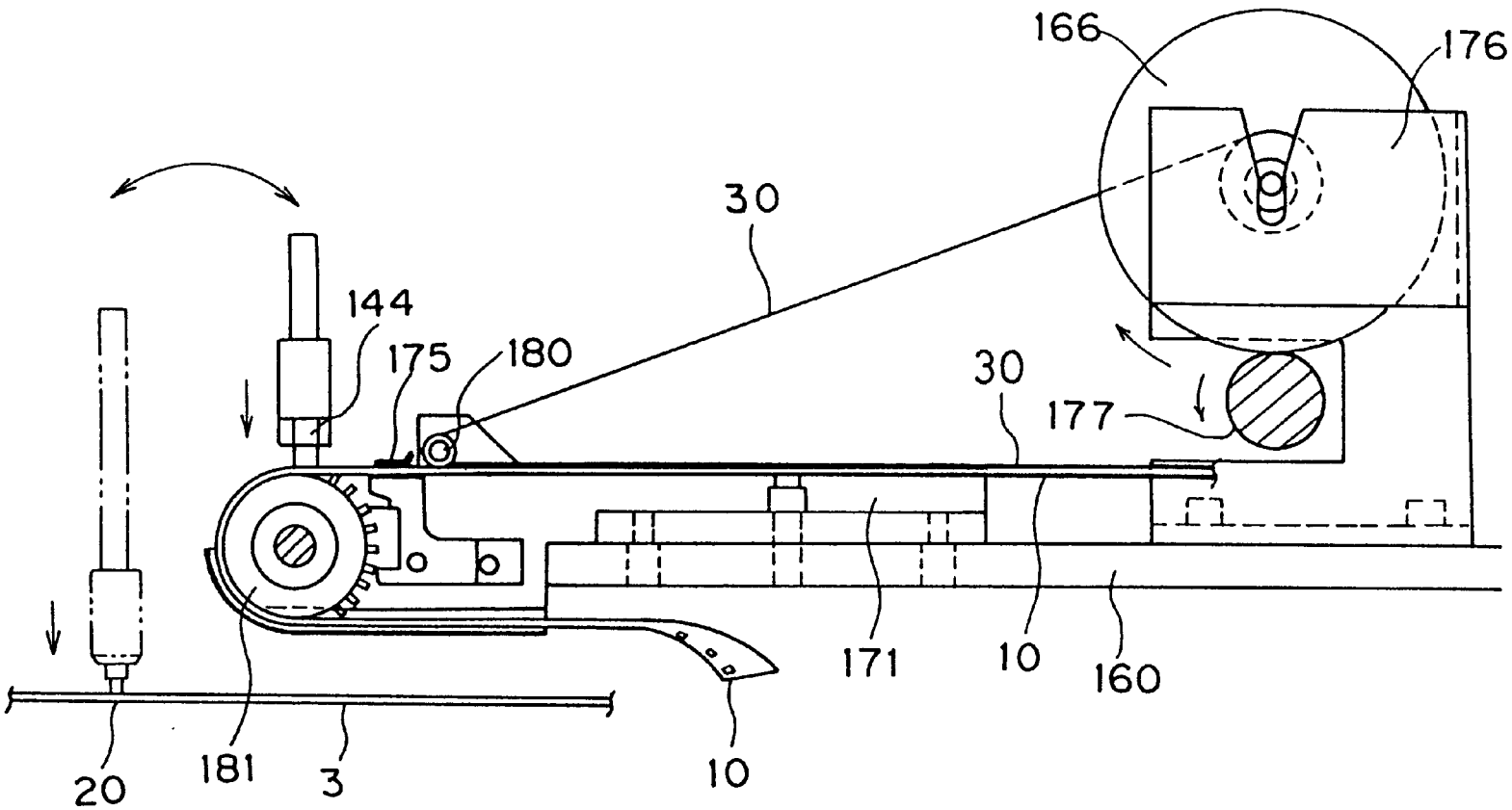
FIG. 5 is a side view showing a mounting apparatus of electronic parts.

A mounting apparatus 160 shown in FIG. 5 is arranged at the upper part of a circuit plate 3 mounting the electronic parts 20. The mounting apparatus 160 comprises a body portion 171 wherein the packing band 10 is arranged at the upper part, a pawl 181 which coincides with the feeding holes 12 of the packing band 10 and rotates intermittently and travels and drives the packing band 10, a vacuum chuck 144 which carry the electronic parts 20 and a reel guide 176 which protects a rolling up reel 166 withdrawing the cover tape 30 peeled off from the packing band 10.

The cover tape 30 is peeled off from the packing band 10 travelled and driven by the pawl 181 and travelling on the upper face of the body portion 171. The cover tape 30 rotated inversely to upper by a pin 180 is pulled up to the rear and is withdrawn by the rolling up reel 166. The rolling up reel 166 is rotated and driven by a rotating axis 177 contacting the surroundings. At the front of the pin 180, a pressing plate 175 which presses the band 10 from the upper side is arranged and prevents that the bands 10 and the electronic parts 20 in the storing dents 14 flow up at the time of peeling off the cover tape 30.

To the storing dents 14 of the band 10 peeled off the cover tape 30, the vacuum chuck 144 is inserted. The vacuum chuck 144 absorbs and takes up the electronic parts 20. The vacuum chuck 144 moves to an upper part of the circuit plate 3 and supplies the electronic parts 20 to the loading positions. By inserting the terminals of the electronic parts 20 to the terminal holes of the circuit plate, the electronic parts are kept in the fixed positions. After, to the steps such as a gilt connecting of the electronic parts 20 to the circuit plate 3, the conventional technique is applied.

After the band 10 taken out the electronic parts 20 is rotated inversely at a lower part of the pawl 181, the band 10 is withdrawn. As the band after the withdrawal is easily disposed by a destruction by fire or a filing-up.

[Press-forming using Press Plate]

Figure 6:
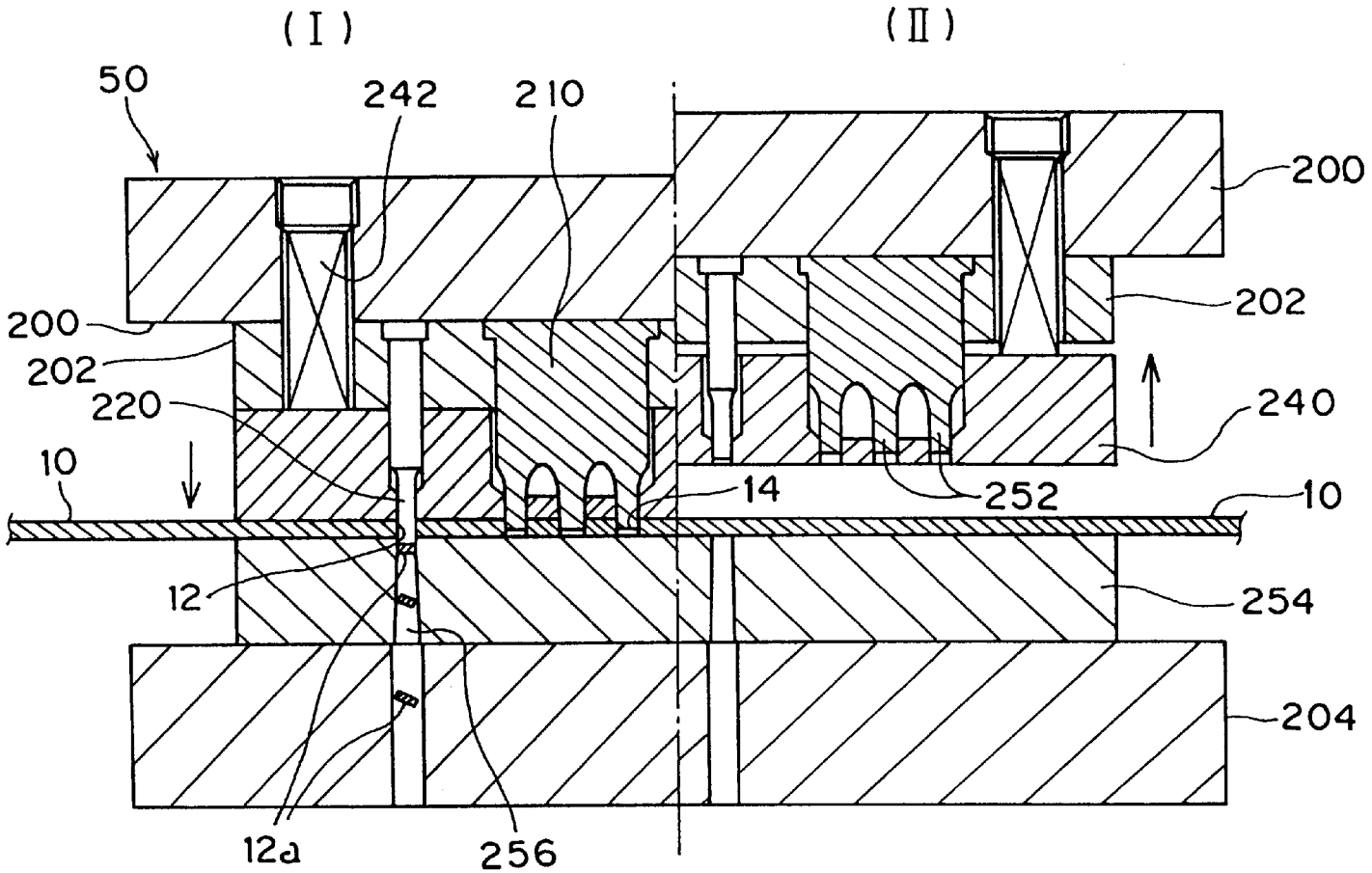
FIG. 6 is a sectional view of a press-forming apparatus showing another embodiment.

In the embodiment shown in FIG. 6, a press plate is used at the time of press-forming. FIG. 6(I) shows the condition while press-forming and FIG. 6(II) shows the condition before press-forming.

The press-forming portion 50 comprises an upper die set 200 which is arranged at upper part of the travelling path of the band 10 and driven by the oil pressure mechanism and so on and moved up and down, and a lower die set 204 which is fixed at lower part of the travelling path of the band 10.

The upper die set 200 comprises a punch plate 202 on the lower face and a driving-in punch 210 and a piercing punch 220 are furnished to the punch plate 202. On the lower edge of the driving-in punch 210, plural press molds 252 are arranged in the projecting condition. Respective press mold 252 press-forms the storing dents 14 to the band 10. The piercing punch pierces the band 10 and forms the feeding holes 12.

To the lower part of the punch plate 202, a movable plate 240 as the press plate is arranged through a spring 242. In the movable plate 240, piercing spaces which the driving-in punch 210 and the piercing punch 220 pass through, are opened.

Above the lower die set 204, a die plate 254 as the base is arranged. The upper face of the die plate 254 is a flat face. In the die plate 254, a piercing hole 256 is formed at the corresponding position to the piercing punch 220. The piercing hole 256 is formed piercing from the die plate 254 to the lower die set 204.

The press-forming movements by the said press-forming portion 50 is explained.

As shown in FIG. 6(I), if the upper die set 200 descends in the condition of arranging the band 10 above the die plate 254, the movable plate 240 touches the upper face of the band. If the upper die set 200 and the punch plate 202 descends further, the spring 242 is compressed and the pointed ends of the press mold 252 and the piercing punch 220 from the lower edge of the movable plate 240 remaining the contacting position of the movable plate 240 to the band 10. The press mold 252 is pushed in the band 10 and the storing dents 14 are formed. The piercing punch 220 pierces the feeding holes 12 to the band 10. A piercing waste 12*a* piercing the feeding holes 12, is exhausted from the piercing hole 256 piercing the die plate 254 and the lower die set. During this time, the movable plate 240 is pushed up to the upper face of the band 10.

As a result, as the band 10 is press-formed in the holding condition between the movable plate 340 of the upper face and the die plate 254 of the lower face, the band 10 does not easily move or change and the processing of the storing dents 14 and the feeding holes 12 is exactly performed. Moreover, as the dimension of the press mold 252 projecting downward from the movable plate 240, that is to say, the dimension of the press mold 252 pushed in the band 10 is fixed, the dimension of the storing dents 14 to the depth direction is established very exactly.

[Press Mold of Taper Like Pointed End]

Figure 7:
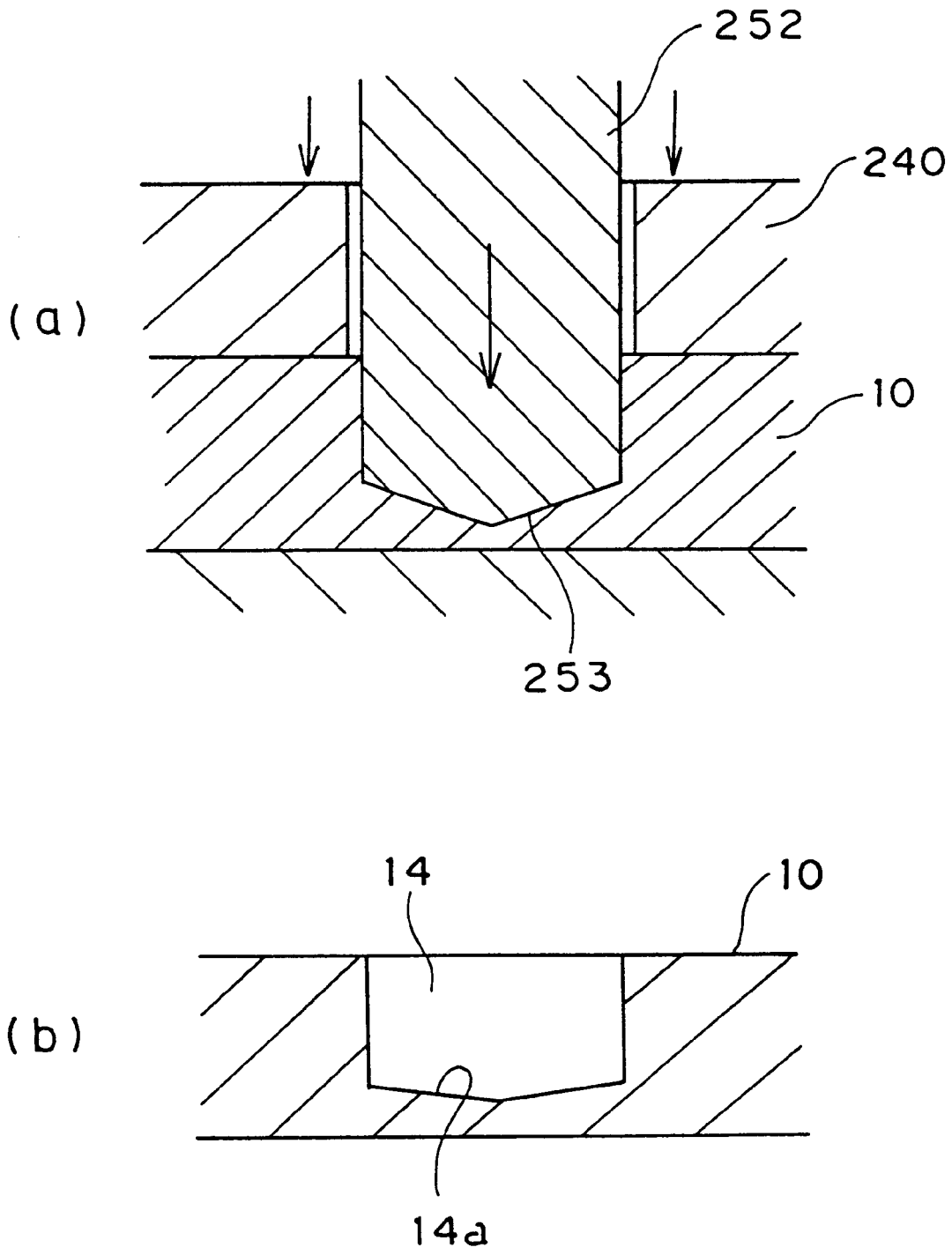
FIG. 7(*a*) is a sectional view of a press-forming step showing another embodiment, and FIG. 7(*b*) is a side view of the tape formed in the step shown in FIG. 7(*a*).

In the embodiment shown in FIG. 7, the figure of the pointed end of the press mold 252, is modified.

As shown in FIG. 7(*a*), the figure of the pointed end of the press mold 252 is a taper face 253 inclined from the center to the surroundings. The establishment of a taper angle can be changed properly according to the necessity.

If the above-mentioned press-forming is performed using the press mold 252 of the above-mentioned structure, the storing dents 14 of the figure shown in FIG. 7(*a*) are formed. At that time, the pointed end taper face 253 of the press mold 252 contacting the flat surface of the band 10, gets in as the material of the band 10 is pushed back right and left and the pushed back material of the band 10 is pushed in to the both sides.

As a result, an inverse force applied from the band 10 to the press mold 252 becomes little and it is prevented that an excessive compress-change and a strain occur only in the bottom portion of the storing dents 14. Also, after forming, the bottom figure of the storing dents reconstructs from a taper figure corresponding to the pointed end taper face 253 of the press mold 252 to a reducing taper by a reconstruction force which the material of the band 10 has. Accordingly, an angle of the pointed end taper face 253 becomes large to some extent, such a large taper as an obstacle occurs to store the electronic parts 20 in the storing dents 14, is not formed.

Moreover, when the pointed end face of the press mold 252 is flat, there is a danger that the bottom face of the storing dents 14 is curved to upper in the center by the reconstruction force of the band 10. However. If the press mold 252 has the pointed end taper face 253, it is prevented that the bottom face of the storing dents 14 is curved to upper.

[Use of Heat-arranging Mold]

Figure 8:
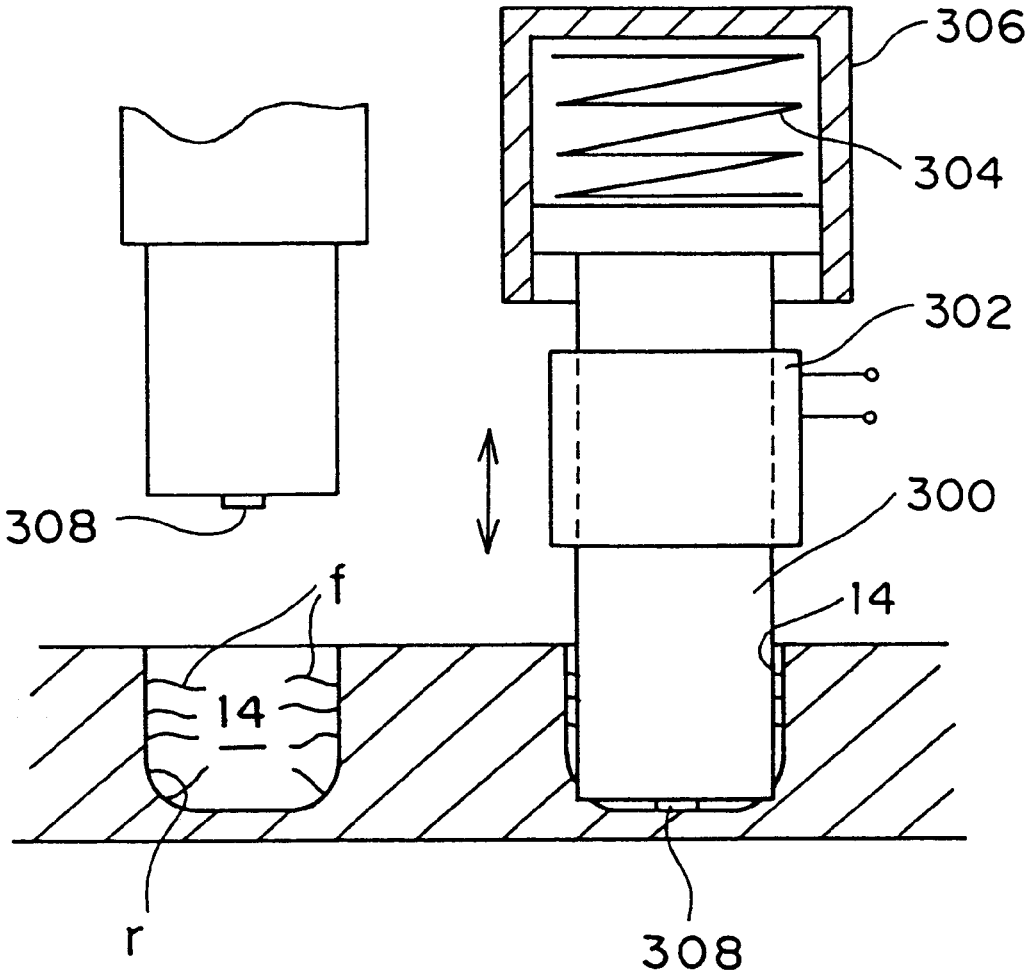
FIG. 8 is a sectional view of a burning mold showing another embodiment.

In the embodiment shown in FIG. 8, a finishing processing by the heat-arranging mold is performed to the press-formed storing dents 14.

As shown in the left part of FIG. 8, there are cases that, in the storing dents 14 of the press-formed step, so-called raising nap occurs wherein a part f of a fiber material projects on the inner face and that a corner portion r of the storing dents 14 occurs a big roundness by the reconstruction after forming. Then, when the electronic parts 20 are inserted in the storing dents 14, the electronic parts 20 catch nap f and the inserting badness occur and it becomes the condition that the electronic parts 220 riding the roundness of the corner portion r incline or flow up.

The heat form-arranging mold 300 is effective to modify the change of the storing dents by the occurrence of nap r or the reconstruction after press-forming.

The heat form-arranging mold 300 has an external form a size smaller than the inner face figure of the storing dents 14. On the surroundings of the heat form-arranging mold 300, a heater 302 is arranged and the heat form-arranging mold 300 can be heated and raised its temperature. The back edge of the heat form-arranging mold 300 is supported by a free-fluctuating supporting pipe 306 through a spring 304. On the center of the lower edge of the heat form-arranging mold 300, a little stopper 308 projects.

When the supporting pipe descends, the heat form-arranging mold 300 is inserted in the storing dents 14. If nap h projecting from the inner wall of the storing dents 14 touches the heat form-arranging mold 300, nap r is burned off by high heater is pressed to the inner wall side of the storing dents 14. If the heat form-arranging mold 300 is pressed to the corner portion r, the corner portion is form-arranged by heat according to the pointed end figure of the heat form-arranging mold 300.

If the pointed end face of the heat form-arranging mold 300 is pressed strongly to the bottom face of the storing dents 24, there are dangers that the thickness of the bottom becomes too thin and that holes are opened. However, as the heat form-arranging mold 300 is supported by the supporting pipe 406 through the spring 304, an excessive pressure is hardly applied. Also, as the stopper 308 which the heat form-arranging mold 300 has on the pointed end, contacts the bottom face of the storing dents, all of the pointed end face of the heat form-arranging mold 300 do not touch strongly to the bottom of the storing dents 14.

[Surface Grinding of Storing Dents]

As mentioned above, there is a case that raising nap and the mustache like projection of the fiber occur in the inner face of the storing dents 14 of the press-formed band 10. Also, there is a case that the local unevenness occurs in the inner face of the storing dents 14.

To remove or modify such mustache and raising nap or the local unevenness, it is effective to jet air and powder grinding material such as diamond sand to inside the storing dents 14. The powder grinding material jet to the inner face of the storing dents, has the function of grinding flowing up portions and projecting portions on the inner side, and removes above-mentioned mustache, raising nap and the local unevenness and so on, and makes the inner face smooth, and improves the dimension accuracy of the storing dents 14. As the inner face of the storing dents 14 becomes smooth, the electronic parts are not caught and the occurrences of resistances are decreased when the electronic parts are inserted and taken out, and the work efficiency of inserts and taking out of the parts is improved.

Various details of the invention may be changed without departing from its spirit not its scope. Furthermore, the foregoing description of the preferred embodiments according to the present invention is provided for the purpose of illustration only, and not for the purpose of limiting the invention as defined by the appended claims and their equivalents.

What is claimed is:

1. A band structure for storing parts, comprising:

a) a band comprising a longitudinal direction, a width direction, and a thickness direction;

b) wherein the band further comprises a first surface and a second surface, with a distance between the first and second surfaces defining a thickness of the band;

c) a plurality of depressions for receiving the parts and being arranged in the band in the longitudinal direction, with each of the depressions extending into the band from the first surface and toward the second surface, with each of the depressions having an inner wall and a floor, with each of the depressions having a depth distance defined from the first surface to the floor, with the depth distance plus a distance between said floor and said second surface being equal to the thickness of the band such that counter portions of the second surface opposite of the depressions do not protrude from the second surface; and d) wherein the band is formed of a flexible paper from the first surface to the second surface.

2. A band structure according to claim 1, wherein the band is made of a material which is able to be compress-formed in a range of 70–95%.

3. A band structure according to claim 1, wherein the thickness of the band is 0.40–0.95 mm.

4. A band structure according to claim 1, wherein the depth distance of said depression is 0.35–0.90 mm.

5. A band structure according to claim 1, wherein an allowable error of the depth distance of said depression is within ±1.5%.

6. A band structure according to claim 1, wherein a width of the band is 4–8 mm.

7. A band structure according to claim 1, wherein a length of the band is 1000–5000 m.

8. A band structure according to claim 1, wherein a weight of the band is 335–730 g/m$^2$.

9. A method for storing parts in a band structure according to claim 1, with the method comprising the following steps (a)–(d):

(a) conveying a band in a first direction prior to forming the depressions;

(b) forming the depressions in the band, with the depressions being formed by a pressing action of a protrusion;

(c) placing the parts into the depressions; and (d) engaging a cover tape to portions of the first surface of the band, with the cover tape covering the depressions so as to capture the parts in the depressions.

10. A method according to claim 9, wherein the step of forming the depressions in the band comprises the steps of:

(a) countering the pressing action of the protrusion with a pressing action of a flat base on the counter portions of the second surface; and (b) countering the pressing action of the protrusion with a pressing action of a flat plate on the first surface about the depressions.

11. A band structure according to claim 1 and further comprising a cover tape for engaging portions of the first surface and for covering the depressions so as to capture the parts in the depressions.

12. A method according to claim 9 and further comprising the step of jetting powder grinding material into the depression after removal of the protrusion to remove fiber from the inner walls and floor.

13. A method according to claim 9, wherein said inner wall and floor of said depression form a juncture upon the pressing action of the protrusion, with the juncture moving partially back into the depression upon removal of the protrusion and thereby decreasing a size of the depression, and with the method further comprising the step of heating the juncture, after removal of the protrusion, to enlarge the depression at the juncture.

14. A method for retrieving the parts from the band according to claim 9, wherein the method of retrieving the parts comprises the steps of:

(a) conveying the band in a first direction;

(b) peeling the cover tape off the band;

(c) taking the parts out of depressions; and (d) moving the parts to a loading position.

15. A band structure according to claim 1, wherein the floor of said depression comprises a circumferential portion and an interior portion, with the circumferential portion being closer to the first surface than is the interior portion whereby, when said depression is formed by a protrusion having a distal end corresponding to said circumferential and interior portions, stress in the band is diverted from the counter portion of the second surface.

16. A band structure according to claim 1, wherein the floor of said depression comprises a taper, with the taper extending toward a central axis of said depression and toward said second surface whereby, when said depression is formed by a protrusion having a distal end corresponding to said taper, stress in the band is diverted from the counter portion of the second surface.

17. A band structure according to claim 1, wherein said inner wall and floor of said depression are free of fiber projecting into the depression.

18. A method according to claim 9 and further comprising the step of heating the inner wall and floor of the depression to remove fiber from the inner walls and floor.

19. A method according to claim 9 and further comprising the step of heating the inner wall and floor of the depression after removal of the protrusion to remove fiber from the inner walls and floor.

20. An apparatus for making depressions in a band and for placing parts in the depressions, with the band comprising a longitudinal direction, a width direction, and a thickness direction; b) wherein the band further comprises a first surface and a second surface, with a distance between the first and second surfaces defining a thickness of the band; c) a plurality of depressions for receiving the parts and being arranged in the band in the longitudinal direction, with each of the depressions extending into the band from the first surface and toward the second surface, with each of the depressions having a floor, with each of the depressions having a depth distance defined from the first surface to the floor, with the depth distance plus a distance between said floor and said second surface being equal to the thickness of the band such that counter portions of the second surface opposite of the depressions do not protrude from the second surface; and d) wherein the band is formed of a flexible paper from the first surface to the second surface; with the apparatus comprising:

(a) conveying means for conveying the band in a first direction;

(b) pressing means for forming the depressions in the band, with the pressing means further comprising first counter pressing means for applying pressure to the first surface of the band about the depressions when the depressions are formed, with the pressing means still further comprising second counter pressing means for applying pressure to the counter portions of the second surface when the depressions are formed;

(c) placing means for placing the parts in the depressions; and (d) engaging means for engaging a cover tape to portions of the first surface of the band and over the depressions to capture the parts in the depressions.

21. An apparatus according to claim 12 and further comprising heat-bonding means for heat-bonding the cover tape to said portions of the first surface of the band.

22. A band structure for storing parts, comprising:

a) a band comprising a longitudinal direction, a width direction, and a thickness direction;

b) wherein the band further comprises a first surface and a second surface, with a distance between the first and second surfaces defining a thickness of the band;

c) a plurality of depressions for receiving the parts and being arranged in the band in the longitudinal direction, with each of the depressions extending into the band from the first surface and toward the second surface, with each of the depressions having an inner wall and a floor, with each of the depressions having a depth distance defined from the first surface to the floor, with the depth distance plus a distance between said floor and said second surface being equal to the thickness of the band such that counter portions of the second surface opposite of the depressions do not protrude from the second surface;

d) wherein the band is formed of a flexible paper from the first surface to the second surface; and e) wherein the thickness of the band is 0.04 to 0.95 mm, said depression has a depth distance of 0.35–0.90 mm, and the depth distance of said depression has an allowable error within plus or minus 1.5%.

23. A band structure according to claim 22, wherein:

(a) a density of the band is in the range of 0.36–0.82 $g/cm^3$;

(b) a rigidity of the band is in a range of 690–1700 gfcm (length)/290–840 gfcm (width); and (c) a moisture content of the band is in a range of 9.5–12%.

* * * * *